US012565767B2

(12) United States Patent
Fagerberg et al.

(10) Patent No.: US 12,565,767 B2
(45) Date of Patent: Mar. 3, 2026

(54) STORAGE AND GRADUAL RELEASE OF STORM WATER WITH MMVF

(71) Applicant: Rockwool A/S, Hedehusene (DK)

(72) Inventors: Morten Agenfeld Fagerberg, Hedehusene (DK); Michaeel Emborg, Hedehusene (DK)

(73) Assignee: Rockwool A/S, Hedehusene (DK)

( * ) Notice: Subject to any disclaimer, the term of this patent is extended or adjusted under 35 U.S.C. 154(b) by 544 days.

(21) Appl. No.: 17/788,258

(22) PCT Filed: Dec. 21, 2020

(86) PCT No.: PCT/EP2020/087504

§ 371 (c)(1),
(2) Date: Jun. 22, 2022

(87) PCT Pub. No.: WO2021/130186

PCT Pub. Date: Jul. 1, 2021

(65) Prior Publication Data

US 2023/0030765 A1 Feb. 2, 2023

(30) Foreign Application Priority Data

Dec. 23, 2019 (EP) ..... 19219285

(51) Int. Cl.
*E03F 5/10* (2006.01)
*E03B 1/04* (2006.01)
(Continued)

(52) U.S. Cl.
CPC ..... *E03F 5/107* (2013.01); *E03B 1/042* (2013.01); *E03B 3/03* (2013.01); *E03F 5/101* (2013.01); *E03F 5/14* (2013.01); *E03B 2001/047* (2013.01)

(58) Field of Classification Search
None
See application file for complete search history.

(56) References Cited

U.S. PATENT DOCUMENTS 289,821 A * 12/1883 Fisher ..... E04D 13/08 137/873
291,863 A * 1/1884 Ball ..... B01D 35/027 210/407
(Continued)

FOREIGN PATENT DOCUMENTS

EP 1961291 A1 8/2008
EP 2085527 A1 8/2009
(Continued)

OTHER PUBLICATIONS

International Search Report mailed on Mar. 16, 2021 in PCT/EP2020/087504.

*Primary Examiner* — Robert J Popovics
(74) *Attorney, Agent, or Firm* — ArentFox Schiff LLP

(57) ABSTRACT

The present invention relates to a storm water management system comprising a first conduit, a storage device, a first well and a valve, wherein the storage device comprises a coherent man-made vitreous fibre module (MMVF module), wherein the MMVF module comprises an upper passage and a lower passage, wherein the upper passage is in fluid communication with the first conduit, and wherein the lower passage is connected to the first well by the valve.

20 Claims, 6 Drawing Sheets

(51) Int. Cl.
*E03B 3/03* (2006.01)
*E03F 5/14* (2006.01)

(56) References Cited

U.S. PATENT DOCUMENTS 316,184 A * 4/1885 Sancan ..... F16K 31/26 137/122
586,662 A * 7/1897 Holmes ..... C02F 1/78 210/314
649,838 A * 5/1900 Harry ..... F16K 31/26 137/122
726,063 A * 4/1903 Hummel ..... E04D 13/08 137/122
914,936 A * 3/1909 Estes ..... F16K 31/26 137/433
1,021,410 A * 3/1912 Johnson ..... F16K 17/02 137/121
1,059,935 A * 4/1913 Guderian ..... C02F 1/001 210/451
1,127,500 A * 2/1915 Overmiller ..... F16K 31/26 137/448
1,312,738 A * 8/1919 Lear ..... F16K 31/26 137/122
1,490,431 A * 4/1924 Pendergraft ..... E03B 3/02 137/122
1,559,941 A * 11/1925 Demaree ..... E03B 3/03 210/422
1,892,039 A * 12/1932 Clarence ..... B01D 35/28 210/433.1
2,032,973 A * 3/1936 Blake ..... E03B 3/02 137/121
2,292,764 A * 8/1942 Levering ..... E03B 3/02 137/448
2,463,814 A * 3/1949 Skinner ..... D21F 1/66 210/232
3,754,362 A * 8/1973 Daimler ..... E04B 1/7023 405/36
4,261,823 A * 4/1981 Gallagher ..... E03F 5/101 210/164
4,296,884 A * 10/1981 Luebke ..... E01F 5/00 405/36
4,299,697 A * 11/1981 Curati, Jr. ..... B61K 11/00 238/1
4,366,846 A * 1/1983 Curati, Jr. ..... E01B 19/006 405/36
4,726,151 A * 2/1988 Vitale ..... E04D 13/08 52/16
4,923,330 A * 5/1990 DeTommaso ..... E03F 1/002 405/36
4,934,404 A * 6/1990 DeStefano ..... E03B 3/03 137/565.33
5,015,123 A * 5/1991 Houck ..... E02B 11/00 405/36
5,234,286 A * 8/1993 Wagner ..... E03B 11/02 220/4.24
5,322,629 A * 6/1994 Stewart ..... E03F 1/00 210/170.03
5,405,539 A * 4/1995 Schneider ..... E03F 5/0404 210/170.03
5,624,204 A * 4/1997 Dorsemaine ..... E03F 5/101 405/36
5,788,409 A * 8/1998 Johnson ..... E03F 1/002 405/36
5,810,510 A * 9/1998 Urriola ..... E02B 11/005 210/170.03
5,836,116 A * 11/1998 Widmann ..... E03B 3/02 137/122
5,848,856 A * 12/1998 Bohnhoff ..... E02B 11/00 405/36
5,873,383 A * 2/1999 Takai ..... E03B 3/03 137/259
5,932,500 A * 8/1999 Jensen ..... C03C 13/00 501/36
5,935,886 A * 8/1999 Jensen ..... C03C 13/00 501/36
5,992,093 A * 11/1999 De Groot ..... A01G 24/18 47/64
6,062,767 A * 5/2000 Kizhnerman ..... B01D 17/0211 210/170.03
6,095,718 A * 8/2000 Bohnhoff ..... E02B 11/00 405/36
6,120,684 A * 9/2000 Kistner ..... B01D 21/0042 210/512.1
6,182,680 B1 * 2/2001 Hart ..... E03B 3/03 137/122
6,190,545 B1 * 2/2001 Williamson ..... B01D 17/0202 210/259
6,350,374 B1 * 2/2002 Stever ..... B01D 21/0006 210/170.03
6,389,748 B1 * 5/2002 De Groot ..... A01G 24/44 47/64
6,619,312 B2 * 9/2003 Doiron ..... E03B 3/02 137/122
6,706,853 B1 * 3/2004 Stanssens ..... D04H 1/4218 428/221
6,711,851 B2 * 3/2004 Mischo ..... A01G 9/033 47/65.9
6,783,683 B2 * 8/2004 Collings ..... B01D 21/2405 210/801
6,821,445 B2 * 11/2004 Miyata ..... B01D 24/263 210/275
7,025,076 B2 * 4/2006 Zimmerman, Jr. ..... E03B 1/04 405/36
7,137,755 B2 * 11/2006 Norman ..... E03F 1/002 405/36
7,425,261 B2 * 9/2008 Siviter ..... E03F 5/12 210/170.03
7,473,055 B2 * 1/2009 Sheridan ..... E03F 1/002 405/53
7,686,540 B2 * 3/2010 Urriola ..... E01C 11/228 405/53
8,221,029 B2 * 7/2012 Henry ..... E03B 3/03 405/36
8,377,291 B2 * 2/2013 Eckman ..... E03B 1/042 210/411
8,871,087 B2 * 10/2014 Kent ..... B01D 39/2089 210/170.03
9,260,321 B2 * 2/2016 Garios ..... E03B 1/041
9,856,638 B2 * 1/2018 Emborg ..... B01D 39/163
9,890,525 B2 * 2/2018 Magar ..... E03D 1/33
10,060,116 B2 * 8/2018 Garios ..... B01D 33/802
10,315,136 B2 * 6/2019 Eckman ..... B01D 29/68
10,422,139 B1 * 9/2019 Warmerdam ..... E04D 11/005
10,711,448 B2 * 7/2020 Emborg ..... E03F 5/10
10,743,481 B2 * 8/2020 De Vries ..... A01G 24/18
10,980,189 B1 * 4/2021 Warmerdam ..... A01G 9/033
11,235,984 B2 * 2/2022 Kelly ..... C02F 9/00
11,401,677 B2 * 8/2022 Carretero ..... E02D 17/202
11,980,835 B2 * 5/2024 Zarraonandia ..... B01D 29/33
12,070,929 B2 * 8/2024 Hjelmgaard ..... C09J 105/04
12,209,051 B2 * 1/2025 De Kubber ..... D04H 1/587
12,276,098 B1 * 4/2025 Chittoor ..... E03F 5/0404
2002/0007593 A1 * 1/2002 Mischo ..... A01G 9/033 47/86
2003/0106859 A1 * 6/2003 Miyata ..... B01D 24/263 210/275
2007/0256966 A1 * 11/2007 Siviter ..... E03F 5/12 210/170.03
2009/0045145 A1 * 2/2009 Kent ..... B01D 39/2089 210/170.03
2009/0200216 A1 * 8/2009 Robinson ..... B01D 21/2405 210/85
2010/0116358 A1 * 5/2010 Takai ..... E03F 1/002 210/170.03
2012/0037234 A1 * 2/2012 Eckman ..... C02F 1/001 137/1
2013/0118999 A1 * 5/2013 Eckman ..... B01D 29/035 210/791

(56) References Cited

U.S. PATENT DOCUMENTS

2013/0220901 A1* 8/2013 Garios ..... E03B 1/041 210/86
2013/0220904 A1* 8/2013 Garios ..... C02F 1/004 210/170.03
2014/0130410 A1* 5/2014 Sumi ..... D04H 1/4209 502/400
2014/0314485 A1* 10/2014 Emborg ..... E03F 1/002 405/36
2015/0129473 A1* 5/2015 Kent ..... E03F 5/14 210/170.03
2015/0151223 A1* 6/2015 Eckman ..... B01D 29/908 210/791
2015/0167286 A1* 6/2015 Emborg ..... E03F 5/0407 210/163
2015/0247313 A1* 9/2015 Emborg ..... E03F 5/101 29/428
2016/0168834 A1* 6/2016 Magar ..... E03D 1/36 137/434
2017/0001132 A1* 1/2017 Garios ..... E03F 3/02
2017/0088437 A1* 3/2017 Garios ..... C02F 1/008
2018/0332783 A1* 11/2018 De Vries ..... E01C 21/00
2019/0024338 A1* 1/2019 Carretero ..... E02B 3/123
2019/0136427 A1* 5/2019 Hjelmgaard ..... D04H 1/4266
2021/0163312 A1* 6/2021 Kelly ..... E03F 5/14
2022/0023778 A1* 1/2022 Zarraonandia ..... C02F 1/001
2022/0282471 A1* 9/2022 Van Der Veld ..... C02F 1/001
2023/0030765 A1* 2/2023 Fagerberg ..... E03B 3/03
2023/0202919 A1* 6/2023 De Kubber ..... C03C 25/14 405/55
2023/0212069 A1* 7/2023 Dekkers ..... D04H 1/4218 264/109
2024/0316533 A1* 9/2024 De Kubber ..... B32B 5/02
2024/0375393 A1* 11/2024 Hjelmgaard ..... C03C 25/1095
2025/0019957 A1* 1/2025 Theunissen ..... E03F 5/10
2025/0243657 A1* 7/2025 Los ..... B01D 39/2089

FOREIGN PATENT DOCUMENTS

EP 3263779 A1 1/2018
EP 4081685 B1 * 11/2024 ..... E03F 5/14
NL 2020137 B1 6/2019
WO 9707664 A1 3/1997
WO 2004007615 A1 1/2004
WO 2007129202 A1 11/2007
WO 2013072082 A1 5/2013
WO 2014029872 A1 2/2014
WO 2017194721 A1 11/2017
WO WO-2021130186 A1 * 7/2021 ..... E03F 5/107
WO WO-2023180535 A1 * 9/2023 ..... E03F 1/005

* cited by examiner

STORAGE AND GRADUAL RELEASE OF STORM WATER WITH MMVF

CROSS-REFERENCE TO RELATED APPLICATIONS

This application is a National Stage Entry of PCT/EP2020/087504, filed Dec. 21, 2020, which claims priority to EP Application Serial No. 19219285.4, filed Dec. 23, 2019, the disclosures of each of which are hereby incorporated by reference in their entirety.

The present invention relates to a storm water management system, a building with a storm water management system and a method of delaying water entering a sewer system.

BACKGROUND TO THE INVENTION

Precipitation such as rain, snow, sleet, hail and the like can be collected separately from sewage as it requires less treatment to be used again. This water can be collected, such as in rain butts and used for watering gardens. This water may be collected and treated by a water company, such as stored in reservoirs and then sanitised to be used as mains water. Storms which cause high levels of precipitation to fall in a short period of time can overwhelm water collection systems. This can cause localised flooding as the systems in place cannot handle the volume of precipitation. It is known to use water attenuation tanks to store storm water and then gradually release water over time.

There is a need for a system that controls the amount of rain water entering a sewer system. There is a need for a system which is quick and easy to install. There is a need for a system where water can be temporarily stored underground, so that above ground space is not used to store water. There is a need for a system that can be installed when there are other utilities underground, such as gas pipes, water pipes and electrical cables.

SUMMARY OF THE INVENTION

According to a first aspect of the present invention, there is provided a storm water management system comprising a first conduit, a storage device, a first well and a valve, wherein the storage device comprises a coherent man-made vitreous fibre module (MMVF module), wherein the MMVF module comprises an upper passage and a lower passage, wherein the upper passage is in fluid communication with the first conduit, and wherein the lower passage is connected to the first well by the valve.

According to a second aspect of the invention, there is provided a building comprising a gutter system in fluid communication with a storm water management system according to the first aspect of the invention.

According to a third aspect of the invention, there is provided a method of delaying water entering a sewer system, comprising providing a storm water management system according to the first aspect of the invention, positioning the storage device in the ground, whereby water flows from the first conduit into the upper passage of the storage device.

According to a fourth aspect of the invention, there is provided the use of a storm water management system according to the first aspect of the invention to store and release water comprising positioning the well and the storage device in the ground, directing water from the first conduit into the storage device and actuating the valve to either store water in the storage device or release water from the storage device.

DETAILED DESCRIPTION

The present invention relates to a storm water management system comprising a first conduit, a storage device, a first well and a valve, wherein the storage device comprises a coherent man-made vitreous fibre module (MMVF module), wherein the MMVF module comprises an upper passage and a lower passage, wherein the upper passage is in fluid communication with the first conduit, and wherein the lower passage is connected to the first well by the valve.

This system controls the amount of rain water entering a sewer system by acting to buffer water until the weather conditions have improved so that the water can be released for disposal in the usual way, such as into a sewer.

The system is quick and easy to install because an existing conduit, such as an existing drain pipe, can be in fluid communication with the storage device. It is an advantage that water can be temporarily stored underground, so that above ground space is not used to store water. Space is at a premium, particularly in built up areas, and it is advantageous that the storage device can store water underground. It is an advantage that the system can be installed when there are other utilities underground, such as gas pipes, water pipes and electrical cables as the MMVF module can be cut to allow such utilities to pass through it. This means that the storage device can be adapted to fit in with and/or around existing utilities. Further, the storage device can be modified after installation to allow utilities to be installed or adapted. Such flexibility is possible because of the structure of the MMVF module and the ability of the MMVF module to hold water within the open pore structure. Further the MMVF module can be cut to the shape required at the point of installation which gives the installer design freedom.

The MMVF module may be placed in direct contact with the ground. The relative suction pressure between the ground and the MMVF module means that water will be retained within the MMVF module when the ground is wet, such that water will not substantially leak out of the MMVF module when it is in contact with the ground. This is important to reduce flooding.

Preferably the water holding capacity of the MMVF module is at least about 80% of the volume of the module, preferably about 85 to about 98%, most preferably about 93 to about 98%. The greater the water holding capacity, the more water can be stored for a given module volume. The water holding capacity of the MMVF module is high due to the open pore structure and the MMVF module preferably being hydrophilic. It will be appreciated that the volume of the MMVF module refers to the volume calculated from the dimensions of the MMVF module.

Preferably the amount of water that is retained by the MMVF module when it emits water is less than about 20% vol, preferably less than about 10% vol, most preferably less than about 5% vol based on the volume of the module. The water retained may be 2 to 20% vol, such as 5 to 10% vol. The lower the amount of water retained by the MMVF module, the greater the capacity of the MMVF module to take on more water.

Preferably the buffering capacity of the MMVF module, that is the difference between the maximum amount of water that can be held, and the amount of water that is retained when the MMVF module gives off water is at least about 60% vol, preferably at least about 70% vol, preferably at least about 80% vol. The buffering capacity may be 60 to 90% vol, such as 60 to 85% vol based on the volume of the module. The advantage of such a high buffering capacity is that the MMVF module can buffer more water for a given module volume, that is the MMVF module can store a high volume of water when required and release a high volume of water into the surrounding ground and air once the ground has dried out and the weather conditions have improved. The buffering capacity is so high because the MMVF module has a lower suction pressure than the surroundings, such as the ground and thus water can dissipate from the MMVF module into the ground. Further, water in the MMVF module can evaporate.

The water holding capacity, the amount of water retained and the buffering capacity of the MMVF module can each be measured in accordance with EN 13041-1999.

The man-made vitreous fibres (MMVF) can be glass fibres, ceramic fibres, basalt fibres, slag wool, stone wool and others, but are usually stone wool fibres. Stone wool generally has a content of iron oxide at least about 3% and content of alkaline earth metals (calcium oxide and magnesium oxide) from 10 to 40%, along with the other usual oxide constituents of MMVF. These are silica; alumina; alkali metals (sodium oxide and potassium oxide) which are usually present in low amounts; and can also include titania and other minor oxides.

Fibre diameter is often in the range of 2 to 10 μm, preferably 2 to 5 μm, more preferably 3 to 4 μm Preferably, the MMVF module comprises man-made vitreous fibres bonded with a cured binder composition. This may be referred to as the MMVF module material.

Preferably at least a portion of the MMVF module material is disposed between the upper passage and the lower passage. This allows the MMVF module to easily absorb water from the lower passage and for the water to dissipate through the MMVF module material.

The MMVF module is in the form of a coherent mass. That is, the MMVF module is generally a coherent matrix of MMVF fibres, which have been produced as such, but can also be formed by granulating a preformed MMVF product and consolidating the granulated material, such as by curing. The binder may be any of the binders known for use as binders for coherent MMVF products. The MMVF module preferably comprises a wetting agent.

Preferably, a coherent MMVF module means a single unified whole MMVF module, preferably the MMVF fibres are adhered to each other and form a single unified whole MMVF module.

Preferably the fibres are arranged substantially horizontally. This facilitates water absorption across a large horizontal cross section of the MMVF module.

Preferably the fibres are arranged substantially vertically. This increases the vertical compression strength of the MMVF module.

The MMVF module is preferably hydrophilic, that is it attracts water. The MMVF module may be hydrophilic due to the binder system used. In the binder system, the binder itself may be hydrophilic and/or a wetting agent used.

The hydrophilicity of a sample of MMVF module can be measured by determining the sinking time of a sample. A sample of MMVF module having dimensions of 100×100×65 mm is required for determining the sinking time. A container with a minimum size of 200×200×200 mm is filled with water. The sinking time is the time from when the sample first contacts the water surface to the time when the test specimen is completely submerged. The sample is placed in contact with the water in such a way that a cross-section of 100×100 mm first touches the water. The sample will then need to sink a distance of just over 65 mm in order to be completely submerged. The faster the sample sinks, the more hydrophilic the sample is. The MMVF module is considered hydrophilic if the sinking time is less than 120 s. Preferably the sinking time is less than about 60 s, preferably less than about 30 seconds.

Normally the MMVF material for MMVF insulation contains oil to make the product hydrophobic. Preferably in the present invention, the MMVF module contains no added oil. Surprisingly, this means the MMVF module is able to absorb water, even when a hydrophobic binder is used.

When the binder is hydrophobic, a wetting agent may additionally be included in the MMVF module. A wetting agent will increase the amount of water that the MMVF module can absorb. The use of a wetting agent in combination with a hydrophobic binder results in a hydrophilic MMVF module. The wetting agent may be any of the wetting agents known for use in MMVF modules that are used as growth modules. For instance, it may be a non-ionic wetting agent such as Triton X-100 or Rewopal. Some non-ionic wetting agents may be washed out of the MMVF module over time. It is therefore preferable to use an ionic wetting agent, especially an anionic wetting agent, such as linear alkyl benzene sulphonate or sodium lauryl ether sulphate (SLES), preferably Texapon. These do not wash out of the MMVF module to the same extent.

EP1961291 discloses a method for producing water-absorbing fibre products by interconnecting fibres using a self-curing phenolic resin and under the action of a wetting agent, characterised in that a binder solution containing a self-curing phenolic resin and polyalcohol is used. This type of binder can be used in the present invention. Preferably, in use, the wetting agent does not become washed out of the MMVF module and therefore does not contaminate the surrounding ground.

Further a phenol-urea-formaldehyde binder can be used, or a binder as described in WO2017/194721.

The binder of the MMVF module can be hydrophilic. A hydrophilic binder does not require the use of a wetting agent. A wetting agent can nevertheless be used to increase the hydrophilicity of a hydrophilic binder in a similar manner to its action in combination with a hydrophobic binder. This means that the MMVF module will absorb a higher volume of water than if the wetting agent is not present. Any hydrophilic binder can be used.

The binder may be a formaldehyde-free aqueous binder composition comprising: a binder component (A) obtainable by reacting at least one alkanolamine with at least one carboxylic anhydride and, optionally, treating the reaction product with a base; and a binder component (B) which comprises at least one carbohydrate, as disclosed in WO2004/007615. Binders of this type are hydrophilic.

WO97/07664 discloses a hydrophilic module that obtains its hydrophilic properties from the use of a furan resin as a binder. The use of a furan resin allows the abandonment of the use of a wetting agent. Binders of this type may be used in the present invention.

WO07129202 discloses a hydrophilic curable aqueous composition wherein said curable aqueous composition is formed in a process comprising combining the following components:

(a) a hydroxy-containing polymer, (b) a multi-functional crosslinking agent which is at least one selected from the group consisting of a polyacid, salt(s) thereof and an anhydride, and (c) a hydrophilic modifier;

wherein the ratio of (a):(b) is from 95:5 to about 35:65.

The hydrophilic modifier can be a sugar alcohol, monosaccharide, disaccharide or oligosaccharide. Examples given include glycerol, sorbitol, glucose, fructose, sucrose, maltose, lactose, glucose syrup and fructose syrup. Binders of this type can be used in the present invention.

Further, a binder composition comprising:

a) a sugar component, and b) a reaction product of a polycarboxylic acid component and an alkanolamine component, wherein the binder composition prior to curing contains at least about 42% by weight of the sugar component based on the total weight (dry matter) of the binder components may be used in the present invention, preferably in combination with a wetting agent.

Binder levels are preferably in the range 1 to 10 wt %, preferably 2 to 6 wt %, most preferably 3 to 5 wt %, based on the weight of the MMVF module.

Levels of wetting agent are preferably in the range 0 to 1 wt %, based on the weight of the MMVF module, in particular in the range 0.2 to 0.8 wt %, especially in the range 0.4 to 0.6 wt %.

The MMVF module may be made by any of the methods known to those skilled in the art for production of MMVF products. In general, a mineral charge is provided, which is melted in a furnace to form a mineral melt. The melt is then formed into fibres by means of centrifugal fiberisation e.g. using a spinning cup or a cascade spinner, to form a cloud of fibres. These fibres are then collected and consolidated. Binder and optionally wetting agent are usually added at the fiberisation stage by spraying into the cloud of forming fibres. These methods are well known in the art.

Preferably, the first conduit is a pipe, preferably a drain pipe, preferably a drain pipe in fluid communication with a gutter on a building. This is a convenient way to collect water falling onto a building. In use, water from the first conduit can flow into the upper passage of the storage device.

Preferably, the first conduit is not perforated.

Preferably the first conduit is substantially vertical. This is an efficient way to transport water.

Preferably a well is deeper than the maximum width of the well. This means that there is a greater height for water to be in the well which helps to separate out any debris that enters the well from the water. Debris includes organic matter (e.g. leaves) which may float on the surface of the water and sediment that may sink to the bottom of the well. Preferably a well comprises a removable or hinged lid. This allows access to the inside of the well to remove any debris for maintenance. A well may also be called a gully. This applies to all wells described in the present application.

Preferably the first well is in fluid communication with the first conduit.

Preferably, the first well has a volume in the range of about 75 litres to about 300 litres. This means that the first well can separate out debris over the height of the well, and additionally hold water. If the first well develops a leak, it will not hold water as it is a container and there is no force to hold water in the well. An advantage of the storage device is that water will be held within the MMVF module when the surrounding ground is wet.

Preferably, the storm water management system further comprises a second well upstream of the first well. Preferably, the volume of the second well is less than the volume of the first well. It is advantageous to have more than one well for maintenance. This is particularly the case as it is easier to clear out the smaller second well as specialist equipment is not required. Preferably the second well has a volume in the range of about 20 litres to about 75 litres.

Preferably, in use, water may flow from the second well into the upper passage, through the MMVF module and into the lower passage. Water may then be released from the lower passage into the first well by actuating the valve.

Preferably, the storm water management system comprises a bypass apparatus wherein the bypass apparatus is in fluid communication with the first conduit and the upper passage. Preferably the bypass apparatus is upstream of the upper passage and the bypass apparatus is downstream of the first conduit. Preferably, the bypass apparatus is for directing water into the upper passage and/or into the first well. Preferably, the bypass apparatus is actuated by the amount of water flowing into it. The bypass apparatus may direct substantially all of the water into the storage device, or substantially all of the water into the first well. The bypass apparatus may direct a first proportion of the water into the storage device and a second proportion of the water into the first well, preferably wherein in storm conditions, a larger proportion of the water is directed into the storage device. The bypass apparatus is not required to divert all of the water into the storage device or away from the storage device, but it is preferable that it is operable to direct substantially all the water into the storage device or away from the storage device.

The bypass apparatus allows the system to control the amount of rain water entering a sewer system by having the option to direct water into the storage device when needed. This is advantageous because under normal weather conditions, rain water will not need to flow into the storage device, but may be disposed of in the usual way, such as by flowing into a sewer. When needed, the storage device can act to buffer the excess water until the weather conditions have improved so that the water can be released for disposal in the usual way, such as into a sewer.

Preferably, the bypass apparatus comprises a deflector, a throttle valve, a perforated conduit or a combination of two or more thereof.

Preferably, the bypass apparatus comprises a deflector. A deflector may be positioned in the first well such that when the flow rate of water from the first conduit into the first well reaches a predetermined level, a proportion of the water is diverted into the upper passage of the storage device, preferably, substantially all of the water is diverted into the upper passage of the storage device.

Preferably, the bypass apparatus comprises a throttle valve. The throttle valve may be positioned in the first conduit or may be positioned in fluid communication with the first conduit. The throttle valve is controlled by the flow of water and preferably in a first position, preferably substantially all of the water flows into the first well. When the flow rate of the water increases, preferably the throttle valve moves to a second position to direct water into the upper passage. Preferably, as the throttle valve moves from the first position, the proportion of the water directed into the upper passage increases. Preferably in the second position, substantially all of the water flows into the upper passage of the storage device.

Preferably, the bypass apparatus directs water into the storage device when water flowing in the first conduit reaches a predefined flow rate. Preferably, the bypass apparatus directs water away from the storage device when water flowing in the first conduit is less than the predefined flow rate. Preferably the bypass apparatus can be actuated to direct water away from the storage device and/or into the storage device. The predefined flow rate is preferably set at a level to direct excess water into the storage device when there is a large amount of rain.

The bypass apparatus may be actuated automatically or may be controlled by a user.

Preferably, the first well comprises an upper outlet and a lower outlet, wherein the upper passage is in fluid communication with the upper outlet of the first well. Preferably, when a predetermined level water is provided in the first well, water flows from the upper outlet of the first well into the upper passage. This provides a convenient way to direct water into the upper passage of the storage device. This allows the storage device to act as an overflow when the level of first well reaches the upper outlet and directs water into the storage device, rather than overflowing from the well. This has the advantage of not requiring a bypass apparatus.

Preferably both a bypass apparatus and the upper outlet of the first well are able to direct water into the upper passage of the storage device. This has the advantage water being directed to both bypass the first well, and to act as an overflow for the first well.

Preferably, the first conduit is connected to the upper passage, preferably directly connected to the upper passage. This has the advantage of substantially all of the water from the first conduit being directed into the storage device. This means that water from the first conduit can be stored, regardless of the amount of water entering the first conduit. Such water can be used at a later point, such as to water plants. Water can be released from the storage device by actuating the valve which will flow into the first well and can be pumped for use.

Preferably water from the first well can be removed, preferably by pumping. Such water can be used, such as to water plants. This preferably applies to any water that enters the first well.

Preferably, the storm water management system further comprises one or more sensors. Preferably the storage device comprises one or more sensors. The sensors are used to measure the amount of water in the storm management system. Preferably the output from the sensors is used to actuate the valve, such that they control whether the valve is open or closed.

Preferably, the storage device comprises at least two sensors at different heights in the storage device, preferably 2 to 6 sensors, preferably 3 to 4 sensors. Providing multiple sensors allows the system to determine the amount of water present in the storage device. Preferably, each sensor is at a different height. This allows the amount of water in each storage device to be monitored. It is preferable that the sensors are arranged at substantially the same length and width positions. This is for ease of construction and to give a reliable reading of the water level over height. Preferably the sensors are in the form of a power cord with the metal ends exposed to the MMVF module. This allows a simple shortcut to act as a sensor.

There may be two or more sensors at the same height and different positions along the length and/or width of the storage device. This allows the distribution of the water across the storage device to be monitored.

Preferably the first well comprises at least one sensor. This can be used to monitor the amount of water present in the first well.

Preferably, the storm water management system comprises a control system for actuating the valve based on input from one or more sensors.

Preferably, the storm water management system further comprises a filter. Preferably, the filter is upstream of the storage device. Preferably, the filter comprises a mesh, preferably a plastic mesh. A filter can be used to remove debris such as leaves and sediment. It is desirable for water to be filtered before it enters a sewer, and in some jurisdictions, this is a requirement. Preferably water flows from the first conduit, through the filter, and then into the upper passage, bypass apparatus or first well. Preferably the filter is positioned at the top of the first well.

Preferably, the first conduit is in fluid communication with a water collection point or a water disposal point, preferably via a sewer. This allows water to be disposed of when it is not directed into the storage device.

A water disposal point is preferably a water treatment works, a river, a stream, a canal or a sea.

A water collection point is preferably a tank or a reservoir.

Preferably, the lower passage is in fluid communication with a water collection point or a water disposal point when the valve is open, preferably via a sewer. This allows water to be stored and then released at a later point in time.

Preferably the valve has an open position, a closed position and at least one intermediate position. This allows the flow of the water out of the storage device to be controlled. Preferably the valve is a shutter valve.

Preferably, the valve may be actuated automatically, or may be controlled by a user.

Preferably, the first well comprises a lower outlet, preferably wherein the lower outlet is positioned in the bottom half of the first well, preferably wherein the lower outlet is in fluid communication with a water collection point or a water disposal point, preferably via a sewer. This allows water to flow out of the first well.

Preferably the lower outlet is above the base of the first well. This allows debris, such as sediment, to accumulate in the bottom of the first well and not enter a sewer. The debris, such as sediment can then be removed, such as by pumping.

Preferably the storm water management system further comprises a trap between the lower outlet of the first well and the water collection point or the water disposal point, preferably via a sewer. The trap allows any debris, such as sediment to settle into the bottom of the first well and reduces the amount of sediment that flows towards the water disposal point or water collection point. Further, it allows floating debris, such as leaves to remain in the first well, as the water level in the first well is preferably above the lower outlet. Further, the trap helps prevent any unpleasant smells from a sewer from entering the well. A first well with a trap may be called a drain interceptor.

Preferably, the storage device comprises a watertight layer, preferably a watertight base layer. A watertight layer substantially prevents water from passing through it. This has the advantage of retaining water within the storage device. A watertight base layer is particularly preferred as gravity will cause water to accumulate at the bottom of the storage device.

Preferably, the storage device comprises a watertight casing, preferably wherein the storage device does not comprise a watertight top layer. A casing preferably means that at least the base and the lower section of the sides of the MMVF module are provided with a watertight layer, preferably the base and substantially all of the sides of the MMVF module are provided with a watertight layer. It is advantageous for the base and the sides of the MMVF module to be watertight to retain water in the storage device. It is preferable for the top layer not to comprise a watertight layer to allow surface water to be absorbed by the storage device. This helps reduce flooding by absorbing and storing surface water, in addition to water from the first conduit, such as a guttering system on a building.

It will be appreciated that water can enter the storage device at the upper passage and leave the storage device at the lower passage, preferably the point that the upper passage and/or the lower passage passes through the watertight layer, where present, is sealed. Preferably the storage device is substantially watertight. This has the advantage of retaining the water in the storage device and prevents any water from leaking out of the storage device.

Preferably, the watertight layer comprises a man-made vitreous fibre layer (MMVF layer), a plastic layer, a rubber membrane or a combination of two or more thereof, preferably a MMVF layer. Preferably the MMVF layer is hydrophobic, preferably the MMVF layer comprises oil. A MMVF layer is particularly preferred as it is long lasting and does not substantially decompose in the ground. This is desirable for environmental reasons. Further, it is easy to cut such a layer to shape. Joins between different parts of the MMVF layer may be sealed, such as by using an adhesive.

The watertight layer preferably has a thickness of about 1 mm to about 5 cm, preferably about 5 mm to about 2 cm. These thicknesses balance space and the resilience of the material to damage such as from stones in the ground. Preferably the MMVF layer has a thickness of about 5 mm to about 2 cm.

Preferably, the upper passage is T shaped. This means that the water can enter the upper passage through a first part of the T and then flow into the branched part of the T. This provides an efficient way for water to enter the MMVF module.

Preferably, the lower passage is T shaped. This means that the water can enter the lower passage and flow into the branched part of the T and/or the first part of the T. Water can then leave the lower passage through a first part of the T. This provides an efficient way for water to leave the MMVF module, when the valve is open.

T shaped means that there is a first part and a branched part. The first part may be offset such that one of the branches of the T is longer than the other. This allows the upper and lower passages to be offset across the width.

Preferably, the upper passage is substantially horizontal. Preferably, the lower passage is substantially horizontal. This provides a convenient way for the water to enter and exit the storage device. Preferably, the upper passage is positioned in a first horizontal plane and the lower passage is positioned in a second horizontal plane. Preferably, the first horizontal plane is above the second horizontal plane.

Preferably the upper passage and the lower passage are offset across the width of the MMVF module. This is to maximise the distance between the upper passage and the lower passage.

Preferably, the upper passage and the lower passage are each independently substantially circular, substantially semi-circular, substantially square or substantially triangular in cross-section, preferably substantially circular or substantially semi-circular in cross-section. These shapes allow water to flow through them.

Preferably the cross-sectional area of the upper passage and/or the lower passage are substantially uniform across their length.

Preferably the cross-sectional area of the upper passage and the lower passage are each independently in the range of about 20 $cm^2$ to about 300 $cm^2$, preferably in the range of about 50 $cm^2$ to about 175 $cm^2$, preferably in the range of about 80 $cm^2$ to about 150 $cm^2$.

Preferably, in use, water is directed by the bypass apparatus into the upper passage of the storage device and dissipates into the MMVF module. Preferably, in use, water leaves the MMVF module when the valve is open via the lower passage.

Preferably, the upper passage and the lower passage may each independently extend across the whole of one dimension of the MMVF module, preferably the width or the length. This makes it easier for the water to dissipate through the MMVF module efficiently. Preferably an open end of the upper passage and/or the lower passage may be sealed. It will be appreciated that the open end of the upper passage in fluid communication with the bypass apparatus and the open end of the lower passage connected to the valve are not sealed.

Preferably the upper passage is in the top half of the MMVF module. Preferably the lower passage is in the bottom half of the MMVF module. This helps the water enter and leave the MMVF module.

Preferably, the upper passage comprises a perforated pipe. Preferably, the lower passage comprises a perforated pipe. Preferably, the diameter of the perforated pipe is about 5 cm to about 20 cm, preferably about 8 cm to about 15 cm, preferably about 10 cm to about 13 cm. Preferably the perforated pipe has a substantially circular cross-section. It helps control the spread of water through the MMVF module by water flowing along the upper passage and out of the perforations and into MMVF module material. Further, it helps water to flow from the MMVF module material, through the perforations into the lower passage. The perforated pipe increases the strength of the MMVF module. This is particularly beneficial when vehicles will pass over the ground in which the MMVF module is positioned. Further a perforated pipe facilitates cleaning as it protects the MMVF module from damage, such as from a water jetter.

Preferably, the MMVF module is cuboidal. This is a convenient shape to manufacture and install.

Preferably, the height of the MMVF module is in the range of about 0.4 m to about 0.8 m, preferably about 0.5 m to about 0.7 m. This is a suitable height for fitting the storage device into the ground.

Preferably, the width of the MMVF module is in the range of about 0.5 m to about 1.5 m, preferably in the range of about 0.7 m to about 1.2 m. Such widths allow an appropriate volume of MMVF module to absorb water.

Preferably, the length of the MMVF module is in the range of about 0.5 m to about 2 m, preferably in the range of about 1 m to about 1.5 m. These are appropriate sizes to allow efficient construction.

Preferably, the MMVF module comprises a plurality of man-made vitreous fibre elements (MMVF elements). This is an efficient way to construct a storage device. It allows flexibility of choosing an appropriate volume of MMVF module for a given use. Further, MMVF elements are easy to handle and install. The MMVF elements preferably comprise features of the MMVF module described herein.

Preferably, a first MMVF element comprises a first groove, which when placed adjacent to a second MMVF element forms the upper passage, preferably wherein the second MMVF element comprises a second groove which lines up with the first groove such that the first and second groove form the upper passage. Preferably, a third MMVF element comprises a third groove, which when placed adjacent to a fourth MMVF element forms the lower passage, preferably wherein the fourth MMVF element comprises a fourth groove which lines up with the third groove such that the third and fourth groove form the lower passage. Providing MMVF elements with grooves makes the storage device easy to install. Each passage can be provided with a perforated pipe as described herein.

Preferably, a first surface between the first MMVF element and the second MMVF element is substantially horizontal or substantially vertical, preferably substantially horizontal. Preferably, a third surface between the first MMVF element and the fourth MMVF element is substantially horizontal or substantially vertical, preferably substantially horizontal. This allows multiple MMVF elements to be efficiently used. An advantage of a substantially horizontal surface is that gravity helps hold the first and second MMVF elements and third and fourth MMVF elements together.

Preferably, the MMVF module comprises an array of MMVF elements. Preferably, some of the MMVF elements comprise a passage and are used to form an upper passage or a lower passage. Preferably some of the MMVF elements do not comprise a passage and may be used to increase the volume of the MMVF module.

Preferably, the MMVF elements comprise fibres arranged substantially horizontally. This facilitates water absorption across a large horizontal cross section of the MMVF element.

Preferably, the MMVF elements comprise fibres arranged substantially vertically. This increases the vertical compression strength of the MMVF element.

Preferably, the MMVF elements are connected to each other, such as using an adhesive or a connector. Preferably the MMVF elements are connected at discrete spots. This allows the water to pass through adjacent MMVF elements. This helps the handling and installation of the MMVF elements.

Preferably the or each MMVF element is cuboidal. Preferably the or each MMVF element has a length in the range of about 0.5 m to about 2 m, preferably in the range of about 1 m to about 1.5 m. Preferably, the or each MMVF element has a width in the range of about 0.5 m to about 1.5 m, preferably in the range of about 0.7 m to about 1.2 m. Preferably the or each MMVF element has a height in the range of about 0.1 m to about 0.5 m, preferably in the range of about 0.1 m to about 0.5 m. Preferably the or each MMVF element has a length of about 2 m and a width of about 0.6 m and a height of about 0.1 m.

Preferably, the density of the MMVF module is in the range of about 75 $kg/m^3$ to about 200 $kg/m^3$, preferably about 90 $kg/m^3$ to about 150 $kg/m^3$, preferably about 90 to about 120 $kg/m^3$. Such densities give the storage device sufficient resilience.

Preferably, the storage device is an underground storage device. Preferably the storage device and the first well are underground, preferably under a pavement, a road, a patio, a car park, a building, a garden or a combination of two or more thereof, preferably under a pavement or a road, preferably under a pavement. It is an advantage of the invention that the storage device can be underground which means that valuable above ground space is not utilised. Further, it is particularly useful for the space under a pavement or road to be utilised.

Preferably, the storm water management system further comprises a particulate layer above the storage device, preferably directly above the storage device. Preferably, the particulate layer comprises aggregate and/or sand, preferably gravel and/or sand, Preferably a paving slab, a flag stone, a brick, a cobble, a tile, concrete, asphalt or a combination of two or more thereof are above the particulate layer, preferably directly above the particulate layer. Preferably a paving slab, a flag stone, a brick, a cobble, a tile or a combination of two or more thereof are above the particulate layer, preferably directly above the particulate layer. Preferably the particulate layer and the paving slab, flag stone, brick, cobble, tile, concrete, asphalt or a combination of two or more thereof form a pavement. Preferably the particulate layer and the paving slab, flag stone, brick, cobble, tile, or a combination of two or more thereof form a pavement. It will be appreciated that other surfaces can be formed, such as a road, a patio, a car park.

It is an advantage of the invention that the storage device can be directly below a surface, such as a pavement, as this is easy to install and uses space efficiently. Further, any surface with gaps allows surface water to be absorbed by the storage device, where a surface of the storage device permits water to be absorbed, Preferably a pavement is a path for pedestrians at the side of a road.

Preferably, an elongate element passes through the storage device, preferably wherein the elongate element is a utility, preferably wherein the utility is an electrical cable, a fibre optic cable, a water pipe, a sewage pipe, a gas pipe or a combination of two or more thereof. It is a particular advantage of the invention that such utilities can pass through the storage device. This is particularly useful under pavements or roads where multiple utilities may be in a given area. It is therefore not necessary to find a completely clear area underground, but it is possible for these utilities to pass through the storage device. It is also possible to install utilities through the storage device at a later date. The utilities will reduce the amount of MMVF module available to buffer and store water, however it is easy to add or adjust the amount of MMVF module that is used.

Preferably the storage device comprises a seal where the elongate element enters and exits the storage device. This helps prevent leakages.

Preferably, the storm water management system further comprises an upper gutter well connected to the upper passage, preferably wherein a pipe connects the upper gutter well to the upper passage. The upper gutter well is preferably used for cleaning such as to wash through the upper passage. Preferably, the upper gutter well is only connected to the upper passage, such that water enters and leaves the upper gutter well by the upper passage. Preferably, the upper gutter well has a removable or hinged lid. This allows access to the inside of the upper gutter well to wash it and remove any debris for maintenance and to remove water, such as to water plants.

Preferably, the storm water management system further comprises a lower gutter well connected to the lower passage, preferably wherein a pipe connects the lower gutter well to the lower passage. The lower gutter well is preferably used for cleaning such as to wash through the lower passage. Preferably, the lower gutter well is only connected to the lower passage, such that water enters and leaves the lower gutter well by the lower passage. Preferably, the lower gutter well has a removable or hinged lid. This allows access to the inside of the lower gutter well to wash it and remove any debris for maintenance and to remove water, such as to water plants.

Preferably, the storm water management system comprises a plurality, preferably an array of storage devices. These storage devices may all be in fluid communication to maximise the area available for storing water. Alternatively, the storage devices may not be in fluid communication with each other and may act as separate water storage means.

Preferably, the storm water management system comprises a plurality, preferably an array of first conduits for example more than one drainpipe may be in fluid communication with a storage device. This allows multiple sources of water to be stored in the same storage device.

Preferably, the storm water management system comprises a plurality, preferably an array of first conduits and a plurality, preferably an array of storage devices. This allows the system to be used for multiple drainpipes, for example for multiple buildings.

The present invention relates to a building comprising a gutter system in fluid communication with a storm water management system as described herein. The invention has particular utility for managing water from guttering systems.

The present invention relates to a method of delaying water entering a sewer system, comprising providing a storm water management system as described herein, positioning the storage device in the ground, whereby water flows from the first conduit into the upper passage of the storage device. Preferably water is stored in the storage device or released from the storage device by actuating the valve.

The present invention relates to the use of a storm water management system described herein to store and release water comprising positioning the well and the storage device in the ground, directing water from the first conduit into the storage device and actuating the valve to either store water in the storage device or release water from the storage device.

Example embodiments of the present invention will now be described with reference to the accompanying figures, in which FIG. 1 shows a cross-section view of a storm water management system.

Figure 1:
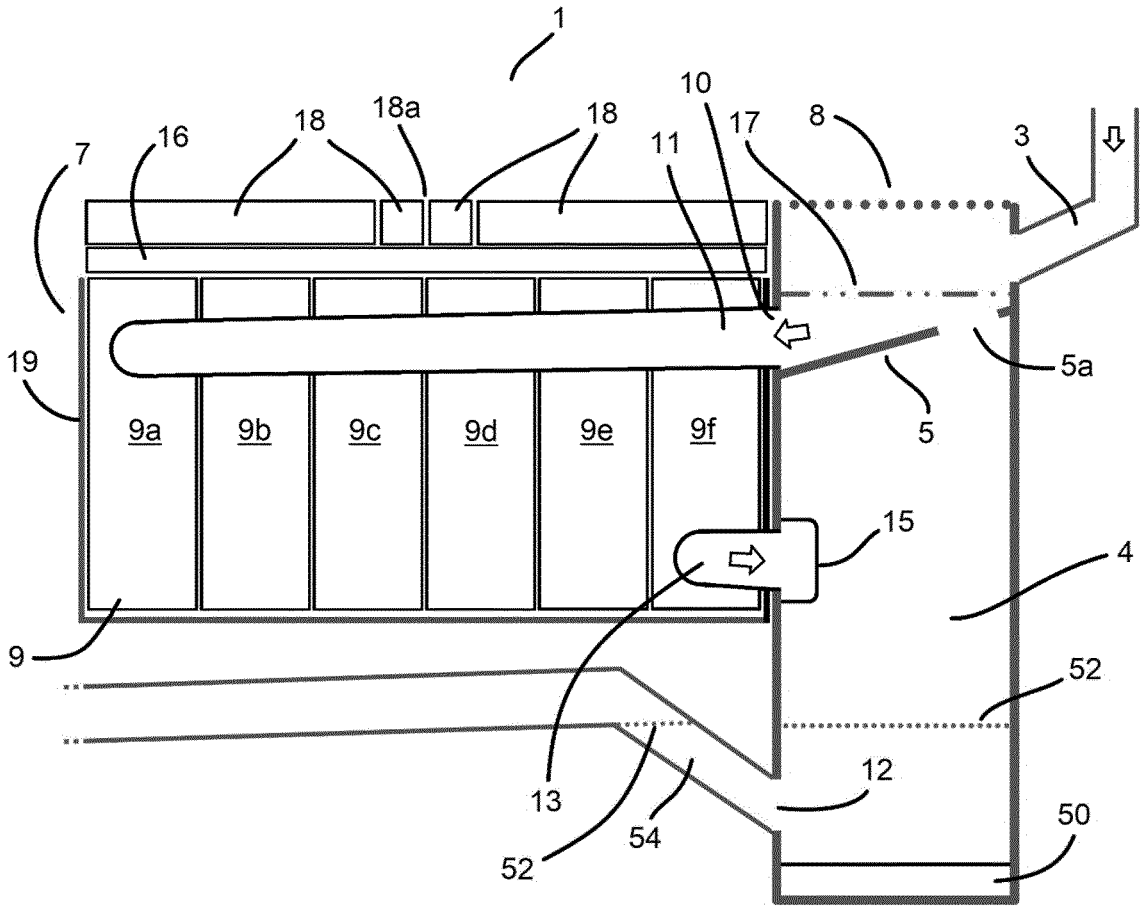

FIG. 1 shows a cross-section view of a storm water management system 1. A first conduit 3 is shown connected to a first well 4. The first conduit 3 is connected to a guttering system on a building (not shown). The first conduit 3 may be connected to a drainpipe of the guttering system (not shown), or may be the drainpipe. The first well 4 has a removable or hinged lid 8 which can be used for cleaning and maintenance and to pump water out of the first well 4. In use, water coming from the roof of a building flows down the first conduit 3, through the filter 17. Water can then either flow directly into the first well 4 or is directed by the bypass apparatus 5 into the upper passage 11 of the storage device 7. The bypass apparatus 5 is shown as a deflector. The bypass apparatus 5 has an aperture 5*a* which allows water to flow directly into the first well 4. When the flow of water down the first conduit 3 increases, water will be directed by the bypass apparatus 5 in to the upper passage 11.

The storage device 7 comprises a MMVF module 9 with an upper passage 11 which is in fluid communication with the first well 4, the first conduit 3 and the bypass apparatus 5. The MMVF module 9 has a lower passage 13 connected by a valve 15 to the first well 4. In use, water flows into the storage device 7 via the upper passage 11 and dissipates through the MMVF module to the lower passage 13. Water is contained in the lower passage 13 when the valve 15 is closed. This allows water to be held in the storage device 7 until the valve 15 is actuated. When the valve is actuated and is opened, water flows from the lower passage 13 and into the first well 4. The upper passage 11 is shown to extend further through the MMVF module 9 than the lower passage 13. This helps distribute water throughout the MMVF module 9. The MMVF module 9 is shown formed of six MMVF elements 9*a*-9*f* which form an array. The MMVF 9*a*-9*f* elements have a greater height than depth and preferably comprise substantial vertical fibres. A watertight layer 19 is shown as a water tight casing which extends along the base and the sides of the MMVF module 9. There is not a watertight top layer to allow water to be absorbed from above the storage device.

A particulate layer 16, such as gravel and/or sand is positioned above the storage device 7 and in direct contact with the upper surface of the MMVF module 9. Paving slabs 18 are positioned above the particulate layer 16 and in direct contact with the particulate layer 16. The paving slabs 18 form a surface, such as a pavement. Water can pass through the paving slabs 18 or through the gaps 18*a* in the paving slabs, through the particulate layer 16 and into the MMVF module 9. In this way, the system can also absorb and store surface water. The first well 4 has an upper outlet 10 in fluid communication with the upper passage 11. The first well 4 has a lower outlet 12 in fluid communication with a with a water collection point or a water disposal point (not shown) via a sewer (not shown). The lower outlet 12 is above the base of the first well 4. This allows debris, such as sediment 50, to accumulate in the bottom of the first well 4 and not enter a sewer (not shown). The water level 52 is shown as above the lower outlet 12. The debris, such as sediment 50 can then be removed, such as by pumping by accessing the first well 4 via the removeable lid 8. A trap 54 is between the lower outlet 12 of the first well 4 and the water collection point or the water disposal point (not shown). The trap 54 allows any debris, such as sediment 50 to settle into the bottom of the first well 4 and reduces the amount of sediment 50 that flows towards the water disposal point or water collection point (not shown). Further, it allows floating debris, such as leaves to remain in the first well 4, as the water level 52 in the first well is preferably above the lower outlet 12. Further, the trap 54 helps prevent any unpleasant smells from a sewer (not shown) from entering the first well 4.

Figure 2:
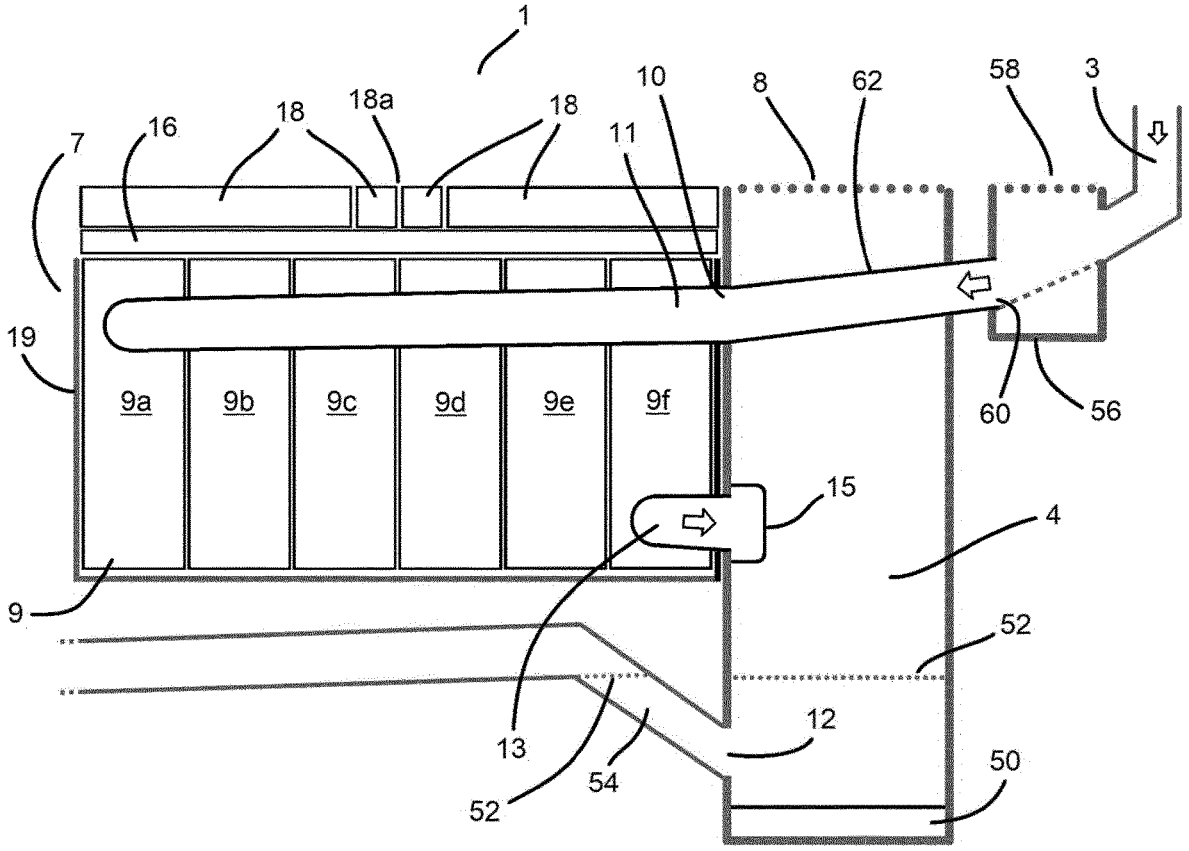
FIG. 2 shows a cross-section view of a storm water management system.

FIG. 2 shows a cross-section view of a storm water management system 1. The storm water management system is as described for FIG. 1, except the part of the system between the first conduit and the upper passage 11. As shown, no filter or bypass apparatus are present. The first conduit 3 is connected to a second well 56. The second well has a removable or hinged lid 58 which can be used for cleaning and maintenance and to pump water out of the second well 56. The second well 56 is smaller than the first well 4. The second well 56 can be cleaned more easily as it has a smaller volume and does not require specialist equipment. The second well 56 has an outlet 60 positioned in the bottom half of the second well. The outlet 60 is not at the very bottom of the second well 56 to allow space for sediment to settle out. A pipe 62 directly connects the second well 56 to the upper passage 11. In use, all water flows into the storage device 7. It will be appreciated that the second well 56 may be used in other embodiments of the invention. Further, in other embodiments the first conduit 3 may be directly connected to the upper passage 11, without a second well 56.

Figure 3:
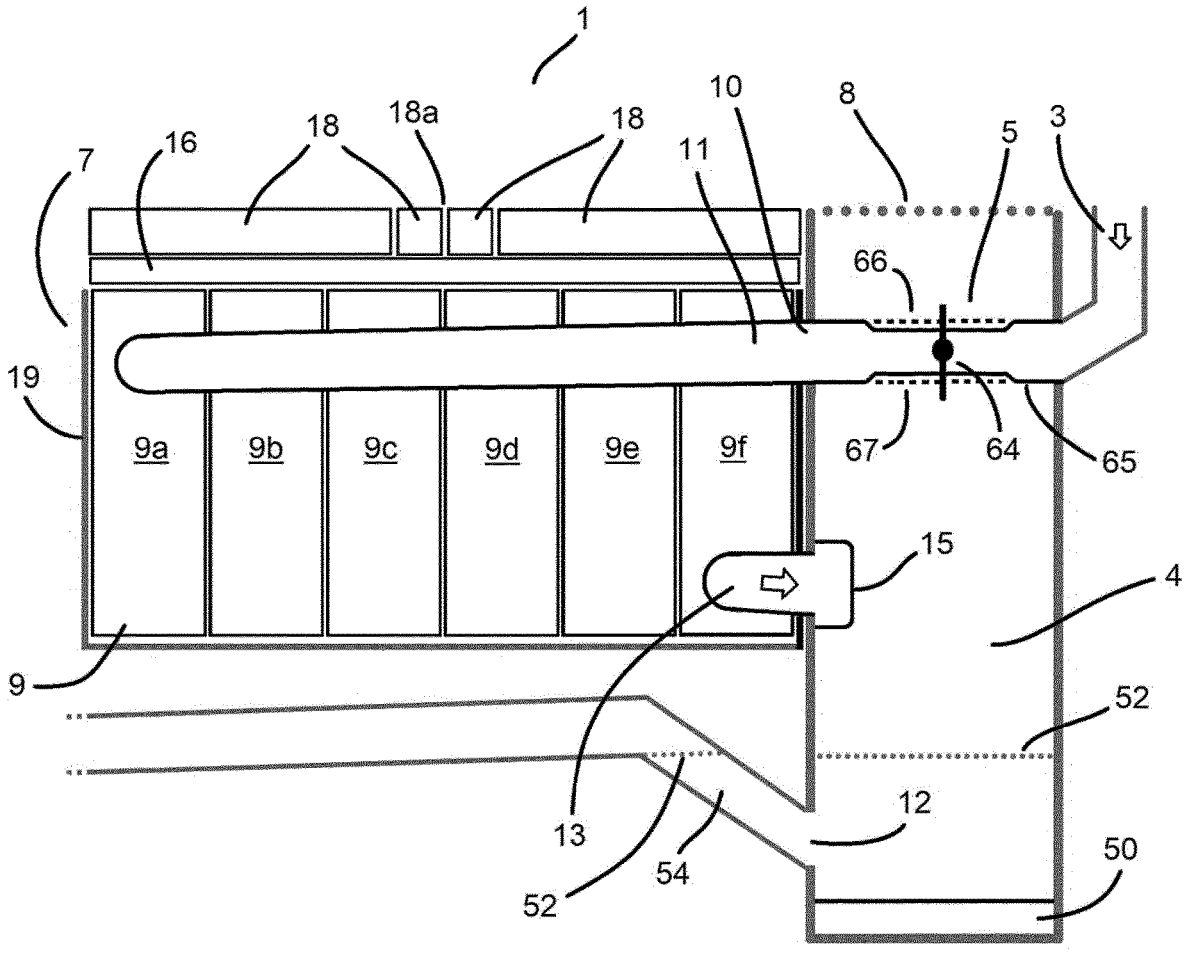
FIG. 3 shows a cross-section view of a storm water management system.

FIG. 3 shows a cross-section view of a storm water management system 1. The storm water management system is as described for FIG. 1, except the part of the system between the first conduit 3 and the upper passage 11. The first conduit 3 is connected to a bypass apparatus 5 which is connected to the upper passage 11. The bypass apparatus 5 has a pipe section 65 with an upper aperture 66 and a lower aperture 67. The throttle valve 64 is shown in a substantially vertical position. When the water flows at a low rate down the first conduit 3 and into the bypass apparatus 5, the throttle valve 64 is in a substantially vertical position and the water flows through the lower aperture 67 and into the first well 4. As the flow of water increases, the throttle valve 64 moves from a substantially vertical position towards a substantially horizontal position. The water is then able to flow through the pipe section 65 and into the upper passage 11 of the storage device 7. In this way, when there is a high flow of water, the bypass apparatus 5 directs the water into the storage device. Preferably, the throttle valve 64 substantially closes the lower aperture 67 when it is in a substantially horizontal position. The throttle valve 64 may only close part of the lower aperture 67.

Figure 4:
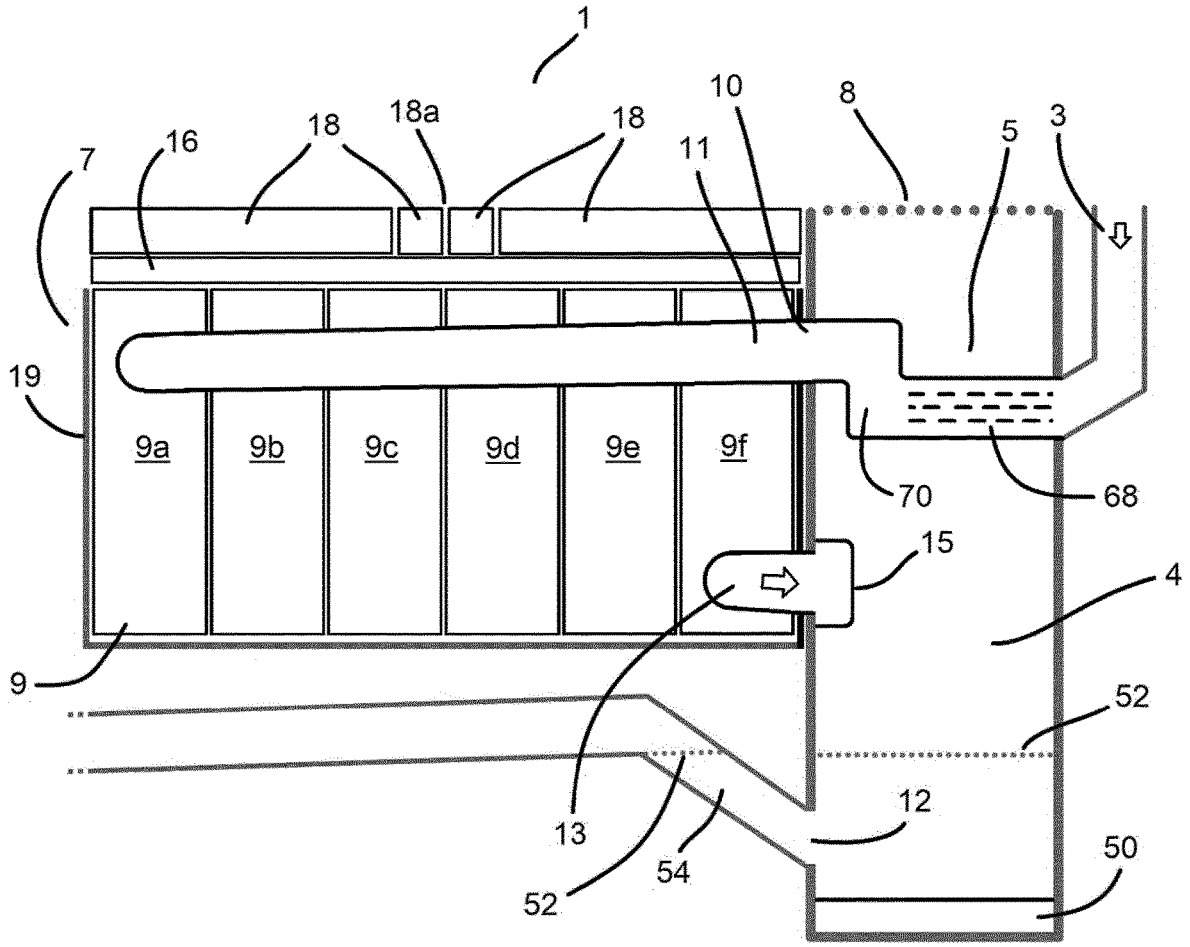
FIG. 4 shows a cross-section view of a storm water management system.

FIG. 4 shows a cross-section view of a storm water management system 1. The storm water management system is as described for FIG. 1, except the part of the system between the first conduit and the upper passage 11. A bypass apparatus 5 is connected to the first conduit 3. The bypass apparatus comprises a perforated pipe 68 between the first conduit 3 and a pipe 70. The pipe 70 is connected to the upper passage 11. In use, water flows from the first conduit 3 into the perforated pipe 68. When the water flow is lower, substantially all of the water will pass through the perforations in the perforated pipe 68 and into the first well 4. When the water flow is higher, some of the water will flow out of the perforated pipe 68 through the pipe 70 and the upper passage 11 of the storage device 7. In this way, when there is a high flow of water, the bypass apparatus 5 directs the water into the storage device.

Figure 5:
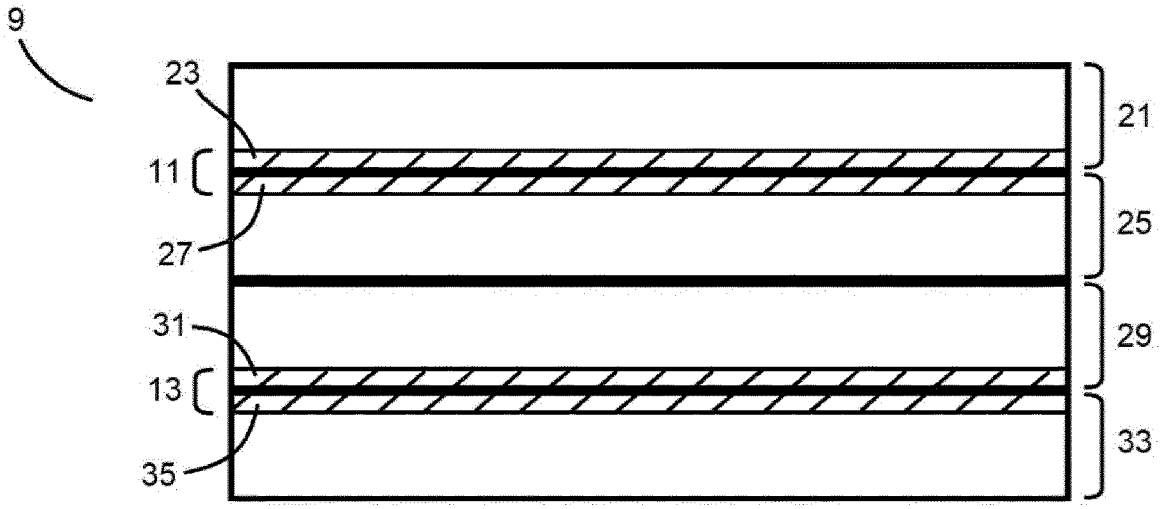
FIG. 5 shows a cross-sectional view of a MMVF module.

FIG. 5 shows a cross-sectional view of a MMVF module 9 formed of four MMVF elements 21, 25, 29 and 33 stacked vertically on top of each other. The first MMVF 21 element has a first groove 23, the second MMVF element 25 has a second groove 27. The first groove 23 lines up with the second groove 27 to form the upper passage 11. The third MMVF element 29 has a third groove 31, the fourth MMVF element 33 has a fourth groove 35. The third groove 31 lines up with the fourth groove 35 to form the lower passage 13. Each passage can be provided with a perforated pipe. This aids the distribution of the water through the MMVF module 9 and improves its strength.

Figure 6:
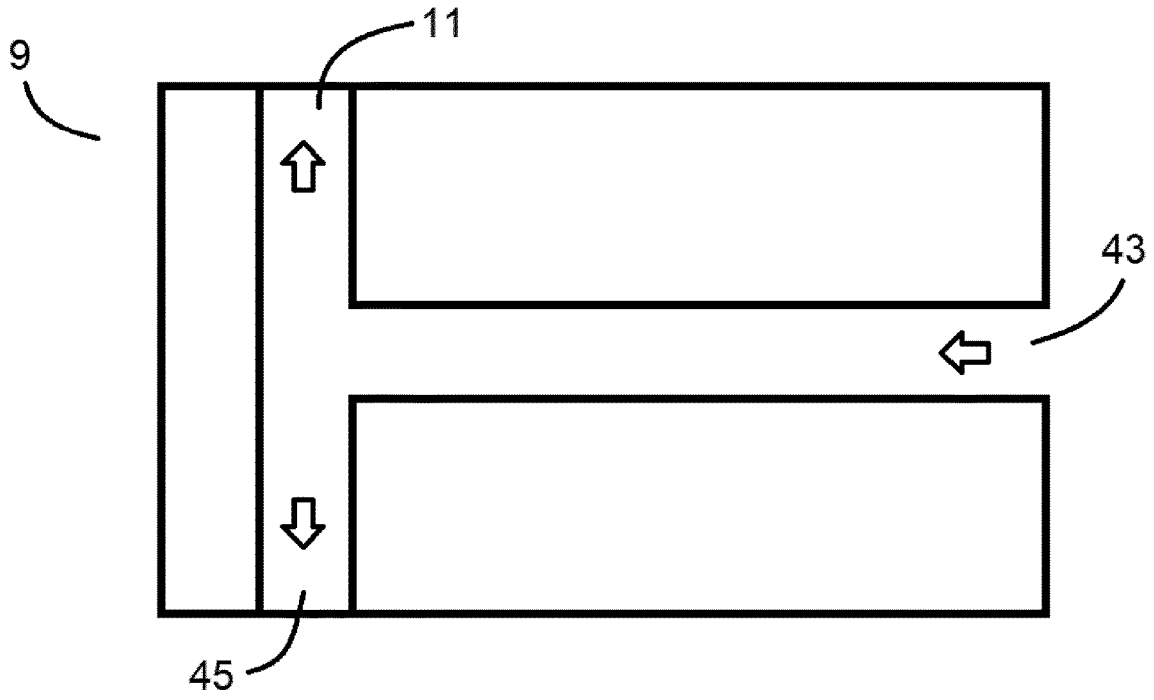
FIG. 6 shows a substantially horizontal cross-sectional view of a MMVF module.

FIG. 6 shows a substantially horizontal cross-sectional view of a MMVF module 9. This shows the upper passage 11 with a T shape. As shown, water can enter the upper passage 11 through a first part of the T 43 and then flow into the branched part of the T 45. The water can then dissipate through the MMVF module.

Figure 7:
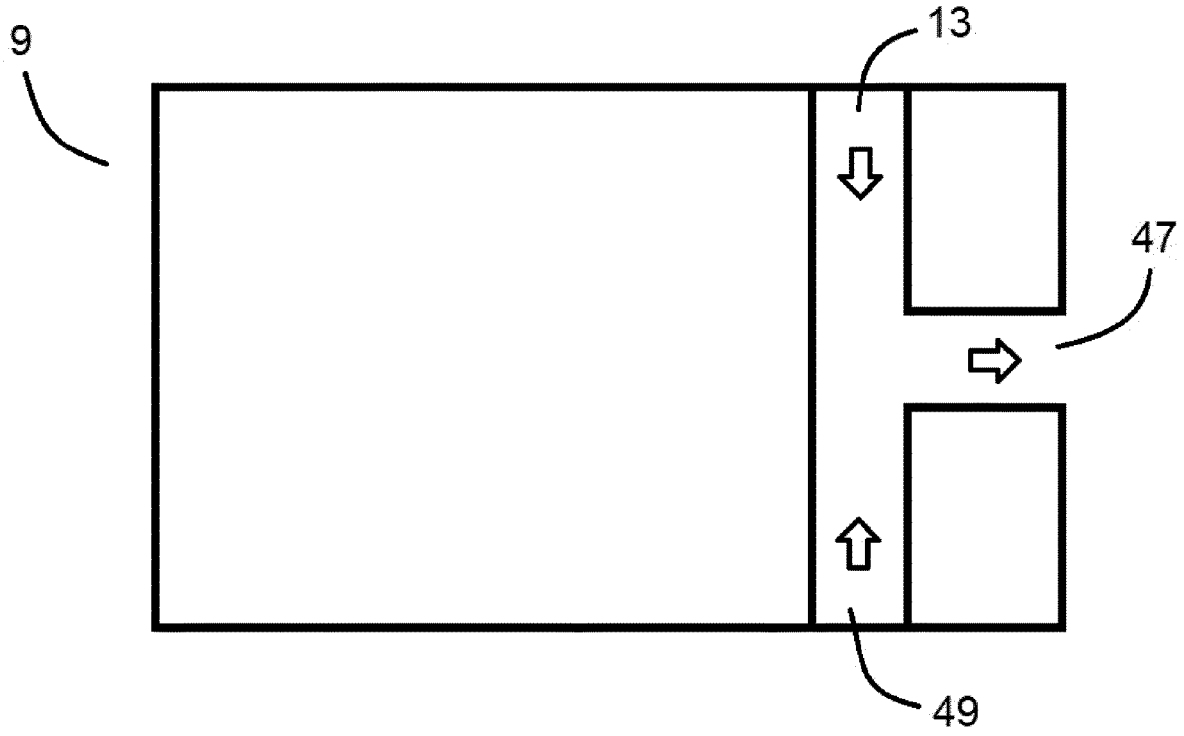
FIG. 7 shows a substantially horizontal cross-sectional view of a MMVF module.

FIG. 7 shows a substantially horizontal cross-sectional view of a MMVF module 9. This shows a lower passage 11 with a T shape. As shown, water can enter the lower passage 11 and flow into the branched part of the T 49 and/or the first part of the T 47 and can then leave the lower passage through a first part of the T 47.

It will be appreciated that FIG. 6 and FIG. 7 are cross-sections through different substantially horizontal planes, with FIG. 6 being through the upper passage 11 and FIG. 7 being through the lower passage 13. When FIG. 6 is positioned on top of FIG. 7, it will be appreciated that the upper passage 11 and the lower passage 13 are offset across the width of the MMVF module 9. This facilitates the water dissipating from the upper passage 11 through the MMVF module 9. Further it facilitates the water leaving the MMVF module 9 as the lower passage 13 is positioned nearer to the first well 4 (not shown).

Figure 8:
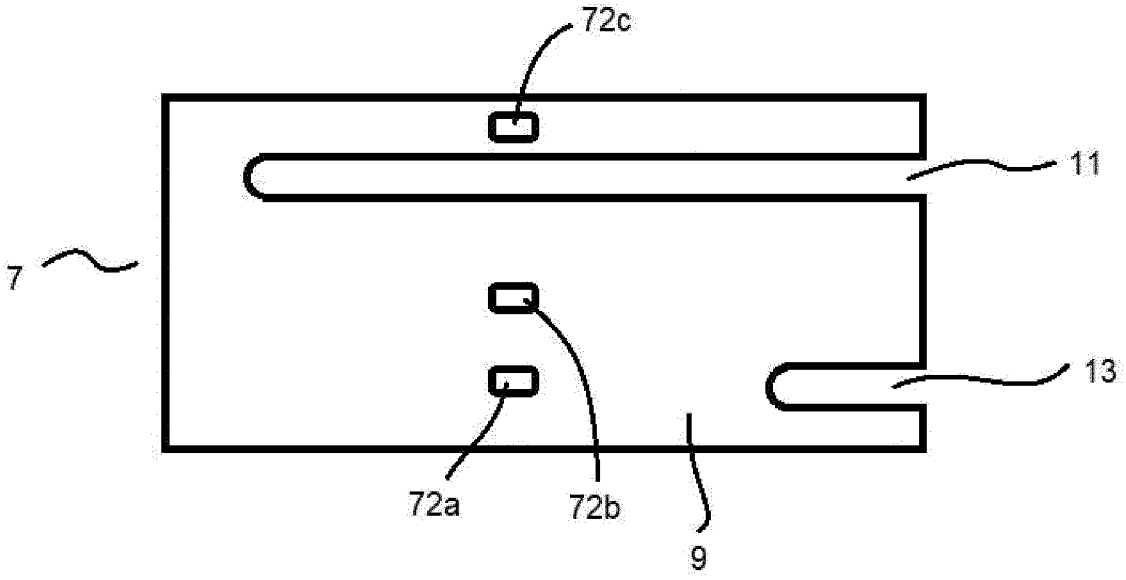
FIG. 8 shows a cross-sectional view of a storage device.

FIG. 8 shows a cross-sectional view of a storage device 7 with a MMVF module 9. An upper passage 11 and a lower passage 13 are shown. Three sensors 72*a-c* are shown at different heights in the MMVF module 9 and can therefore be used to monitor the amount of water in the storage device 7. The sensors 72*a-c* are shown at substantially the same positions across the width/length of the MMVF module 9. The sensors are shown at different heights. It is preferable that the sensors are arranged at substantially the same length and width positions, however they may be arranged at different width/length positions in some embodiments.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein and vice versa.

Within this specification, the term "about" means plus or minus 20%, more preferably plus or minus 10%, even more preferably plus or minus 5%, most preferably plus or minus 2%.

Within this specification, the term "substantially" means a deviation of plus or minus 20%, more preferably plus or minus 10%, even more preferably plus or minus 5%, most preferably plus or minus 2%.

Within this specification, reference to "substantially" includes reference to "completely" and/or "exactly". That is, where the word substantially is included, it will be appreciated that this also includes reference to the particular sentence without the word substantially.

Within this specification, reference to "prevents" includes substantially prevents and completely prevents.

Within this specification "rain" includes all precipitation.

Within this specification, "watertight layer" means that in use in the present invention, substantially no water passes from one side of the layer, through the layer to the other side.

Within this specification, "connected" may be directly connected, or indirectly connected, such as by an additional component, preferably directly connected.

Within this specification, "fluid communication" means that fluid, preferably liquid, preferably water, may flow from one part to another part. The pathway may be direct between the two parts, or the fluid communication may be via other parts.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications are covered by the appended claims.

The invention claimed is:

1. A storm water management system comprising:

a first conduit for delivery of storm water into the system;

a first well in fluid communication with the first conduit, capable of receiving storm water from the first conduit;

a valve;

a storage device comprises a man-made vitreous fiber module (MMVF module) comprising at least one man-made vitreous fiber element (MMVF element) with an open pore structure which is capable of absorbing and holding water, the MMVF module comprises an upper passage and a lower passage, wherein the upper passage is in fluid communication with the first conduit, the lower passage is fluidically connected to the first well by the valve which controls flow between the lower passage and the first well; and a bypass water flow control apparatus in fluid communication with the first conduit and the upper passage, and being capable of selectively directing storm water from the first conduit into the upper passage and/or into the first well.

2. The storm water management system according to claim 1, wherein the bypass water flow control apparatus comprises a deflector, a throttle valve, a perforated conduit or a combination of two or more thereof.

3. The storm water management system according to claim 1, wherein the first conduit is a pipe.

4. The storm water management system according to claim 1, wherein the first well comprises an upper outlet and a lower outlet, wherein the upper passage is in fluid communication with the upper outlet of the first well, and optionally wherein, when a predetermined storm water level is attained in the first well, accumulated storm water in the first well flows through the upper outlet of the first well into the upper passage.

5. The storm water management system according to claim 1, further comprising a filter, wherein the filter is positioned to initially filter storm water from the first conduit as it enters the system.

6. The storm water management system according to claim 1, wherein the upper passage and/or the lower passage comprise a perforated pipe.

7. The storm water management system according to claim 1, wherein the first well comprises a lower outlet, wherein the lower outlet is positioned in the bottom half of the first well, wherein the lower outlet is in fluid communication with a water collection point or a water disposal point; and/or further comprising a trap between the lower outlet of the first well and the water collection point of the water disposal point.

8. The storm water management system according to claim 1, wherein the storage device comprises a watertight layer, wherein the watertight layer comprises a man-made vitreous fiber layer (MMVF layer), a plastic layer, a rubber membrane or a combination of two or more thereof.

9. The storm water management system according to claim 1, wherein the MMVF module is hydrophilic.

10. The storm water management system according to claim 1, wherein the MMVF module comprises a plurality of MMVF elements, wherein a first MMVF element comprises a first groove, which when placed adjacent to a second MMVF element forms the upper passage, wherein the second MMVF element comprises a second groove which lines up with the first groove such that the first and second groove form the upper passage; and/or wherein a third MMVF element comprises a third groove, which when placed adjacent to a fourth MMVF element forms the lower passage, wherein the fourth MMVF element comprises a fourth groove which lines up with the third groove such that the third and fourth groove form the lower passage.

11. The storm water management system according to claim 1, wherein the MMVF module comprises a plurality of MMVF elements, wherein a first MMVF element comprises a first groove, which when placed adjacent to a second MMVF element forms the upper passage, wherein the second MMVF element comprises a second groove which lines up with the first groove such that the first and second groove form the upper passage; and/or wherein a third MMVF element comprises a third groove, which when placed adjacent to a fourth MMVF element forms the lower passage, wherein the fourth MMVF element comprises a fourth groove which lines up with the third groove such that the third and fourth groove form the lower passage wherein a first surface between the first MMVF element and the second MMVF element is substantially horizontal or substantially vertical; and/or a third surface between the third MMVF element and the fourth MMVF element is substantially horizontal or substantially vertical.

12. The storm water management system according to claim 1, wherein the device is an underground storage device.

13. The storm water management system according to claim 1, wherein an elongate element passes through the storage device.

14. The storm water management system according to claim 13, wherein the elongate element is a utility, comprising an electrical cable, a fiber optic cable, a water pipe, a sewage pipe, a gas pipe or a combination of two or more thereof.

15. The storm water management system according to claim 1, further comprising an upper gutter well connected to the upper passage, wherein a pipe connects the upper gutter well to the upper passage; and/or further comprising a lower gutter well connected to the lower passage, wherein a pipe connects the lower gutter well to the lower passage.

16. A method of delaying storm water entering a sewer system, comprising:

providing a storm water management system comprising:

a first conduit for delivery of storm water into the system;

a first well in fluid communication with the first conduit, capable of receiving storm water from the first conduit;

a valve;

a storage device comprises a man-made vitreous fiber module (MMVF module) comprising at least one man-made vitreous fiber element (MMVF element) with an open pore structure which is capable of absorbing and holding water, the MMVF module comprises an upper passage and a lower passage, wherein the upper passage is in fluid communication with the first conduit, the lower passage is fluidically connected to the first well by the valve which controls flow between the lower passage and the first well; and a bypass water flow control apparatus in fluid communication with the first conduit and the upper passage, and being capable of selectively directing storm water from the first conduit into the upper passage and/or into the first well;

positioning the storm water management system in the ground; and allowing storm water to flow from the first conduit into the upper passage of the storage device.

17. The method of delaying storm water entering a sewer system according to claim 16, further comprising:

storing the storm water that has flowed into the storage device for a period of time.

18. The method of delaying storm water entering a sewer system according to claim 17, further comprising:

allowing the stored storm water within the storage device to flow to the first well by actuating the valve.

19. The method of delaying storm water entering a sewer system according to claim 16, further comprising:

allowing storm water within the storage device to flow to the first well by actuating the valve.

20. A method of storing or releasing storm water comprising:

providing a storm water management system comprising:

a first conduit for delivery of storm water into the system;

a first well in fluid communication with the first conduit, capable of receiving storm water from the first conduit;

a valve;

a storage device comprises a man-made vitreous fiber module (MMVF module) comprising at least one man-made vitreous fiber element (MMVF element) with an open pore structure which is capable of absorbing and holding water, the MMVF module comprises an upper passage and a lower passage, wherein the upper passage is in fluid communication with the first conduit, the lower passage is fluidically connected to the first well by the valve which controls flow between the lower passage and the first well; and a bypass water flow control apparatus in fluid communication with the first conduit and the upper passage, and being capable of selectively directing storm water from the first conduit into the upper passage and/or into the first well;

positioning the storm water management system in the ground;

allowing storm water to flow from the first conduit into the upper passage of the storage device; and actuating the valve to either store storm water in the storage device or release storm water from the storage device.

* * * * *